US006364420B1

(12) United States Patent
Sollami

(10) Patent No.: US 6,364,420 B1
(45) Date of Patent: Apr. 2, 2002

(54) BIT AND BIT HOLDER/BLOCK HAVING A PREDETERMINED AREA OF FAILURE

(75) Inventor: Phillip Sollami, Herrin, IL (US)

(73) Assignee: The Sollami Company, IL (US)

( * ) Notice: Subject to any disclaimer, the term of this patent is extended or adjusted under 35 U.S.C. 154(b) by 0 days.

(21) Appl. No.: 09/273,690

(22) Filed: Mar. 22, 1999

(51) Int. Cl.[7] ..... E21C 35/18
(52) U.S. Cl. ..... 299/106; 299/104; 299/110
(58) Field of Search ..... 299/104, 106, 299/110, 102, 103, 107

(56) References Cited

U.S. PATENT DOCUMENTS

| | | | | | |
|---|---|---|---|---|---|
| 3,512,838 | A | * | 5/1970 | Kniff | 299/87.1 |
| RE29,900 | E | * | 2/1979 | Kniff | 299/106 |
| 5,067,775 | A | * | 11/1991 | D'Angelo | 299/104 |
| 5,098,167 | A | * | 3/1992 | Latham | 299/104 |
| 5,318,351 | A | * | 6/1994 | Walker | 299/104 |
| 5,374,111 | A | | 12/1994 | Den Besten et al. | |
| 5,842,747 | A | * | 12/1998 | Winchester | 299/104 |
| D420,013 | S | * | 2/2000 | Warren et al. | D15/21 |
| 6,244,665 | B1 | * | 6/2001 | Bise et al. | 299/106 |

FOREIGN PATENT DOCUMENTS

| | | | | |
|---|---|---|---|---|
| WO | 413917 | * | 2/1991 | 299/104 |
| WO | 000721 | * | 5/2000 | |

* cited by examiner

*Primary Examiner*—David Bagnell
*Assistant Examiner*—Sunil Singh
(74) *Attorney, Agent, or Firm*—Patnaude & Videbeck

(57) ABSTRACT

Improvements in bits, bit holders and bit blocks used in road resurfacing equipment and mining and trenching equipment provide for improved rotatable bit holders in the bit block, ease of removability of bits from bit holders and for predetermined points of desired failure of any member of the combination if the bit should encounter a hard discontinuity while performing its work.

2 Claims, 7 Drawing Sheets

BIT AND BIT HOLDER/BLOCK HAVING A PREDETERMINED AREA OF FAILURE

This invention relates generally to road surface removal or reclaimer-stabilizer equipment and mining equipment, and more particularly, to cutter bit holders and bit blocks used in such road milling, mining, and trenching equipment.

BACKGROUND OF THE INVENTION

Cutter bits are utilized in road, off-road and mining machinery on the perimeter and across the width of a rotary drum or on the outside of a continuous chain or the like where the bits are moved through an orbit which is intercepted by the face of the material being removed or recycled. Road milling equipment removes the defective surface of a road and smooths the top of all or selected portions of the road surface. The bits include a tip and a shank. The shank is received and may axially rotate in a bit holder which is secured onto a bit block that, in turn, is mounted on the drum. Each of the bits has a hardened tip, preferably made of tungsten carbide or such other hardened material that acts to remove a portion of the surface it contacts. By using a sufficient number of these bits around the outer surface of a rotating drum, a large amount of surface may be worked. Any surface being worked generally has a hardness which can be measured or anticipated prior to the removal operation. However, such road surfaces, or surfaces being removed have hardened irregularities running therethrough. The toughness or hardness of the irregularities may result in the breakage of the bits and holders as they are being run over such irregularities.

Additionally, as bits and bit holders wear during the removal process, that wear may be uneven. It would be desirable to be able to selectably change the radial orientation of the bit holder in the bit block. U.S. Pat. No. 5,106,166 discloses a bit retaining sleeve (bit holder) having four flats positioned at 90 degree orientations therearound which fit onto a flat fixation surface on the bit holder to allow the worn bit holder to be positioned in one of four radial orientations in the bit block. A need has developed for an improved means for positioning and mounting a bit holder in a bit block that provides for changing the radial orientation of the bit holder in the bit block as the holder becomes worn.

Further, a need has developed for providing ease of removability of bits in their bit holders, especially when the bit becomes worn and need to be replaced. U.S. Pat. No. 5,374,111 discloses an undercut flange at the bottom of a base of a bit that allows a pry bar to be wedged between that flange and the top of the bit block (no bit holder in this patent) to help remove a bit from a bit block. It would be desirable to provide a more efficient means for allowing the removal of a bit from a bit holder or a bit block.

Additionally, tightening a small fastener on the bottom of a bit holder to hold it in the bit block concentrates friction forces on a small area of the nut top face and the bottom of the bit block. It would be desirable to spread those friction forces over a larger area.

It is, therefore, an object of the present invention, generally stated, to provide an improved means for quickly removing a bit from its bit holder, or a bit block if a bit holder is not utilized.

Another object of the present invention is the provision of an improved means for changing the radial orientation of the mounting of a bit holder on a bit block.

Another object of the invention is the provision of an improved means for providing for breakage of inexpensive replaceable parts when road resurfacing equipment and mining equipment bits encounter very hard irregularities in the surface being milled or mined.

SUMMARY OF THE INVENTION

The invention is directed to a bit assembly for use in road milling and mining equipment. The bit assembly includes a bit having a hardened distal end connected to a shank portion and means including a shank receiving bore for mounting the bit on that equipment. The invention resides in an improvement comprising a reduced cross section means on one of the bit and the means for mounting the bit on the equipment. This reduced cross section means provides a predetermined area of failure for when the bit contacts a hard discontinuity in material it encounters.

The invention is further directed to a bit holder for retaining a bit therein as a part of a bit assembly. The bit holder comprises a generally frustoconical bit mounting portion including a top surface, a mediate portion tapering outwardly from the top surface and a radial flange defining the bottom thereof. The shank portion extends axially from the radial flange and terminates in a fastening portion adjacent a distal end of the shank. An axial bore is in communication with and extends inwardly from the top surface and is adapted for mounting a bit therein. The invention resides in indent means extending radially inwardly from an outer surface of the mediate portion and in communication with the top surface. The indent means provides access to an underside of any bit mounted on the bit holder and resting on the top surface thereof to aid in any removal of a bit from the bit holder and provides for axially turning the bit holder with respect to the bit block.

BRIEF DESCRIPTION OF THE DRAWINGS

The features of the present invention which are believed to be novel are set forth with particularity in the attached claims. The invention may best be understood by reference to the following description taken in conjunction with the accompanying drawings in which like numerals refer to like parts, and in which:

DETAILED DESCRIPTION OF THE PREFERRED EMBODIMENTS

Referring to FIGS. 1–5, a bit mounting assembly, generally indicated at 20, constructed in accordance with the present invention, includes a bit, generally indicated at 21, which is mounted on a bit holder, generally indicated at 22, which, in turn, is secured on a bit block, generally indicated at 23. The bit block 23 is one of a plurality of such blocks mounted around the outside of the generally circular drum (not shown) or on a movable chain or track (not shown).

Figure 2:
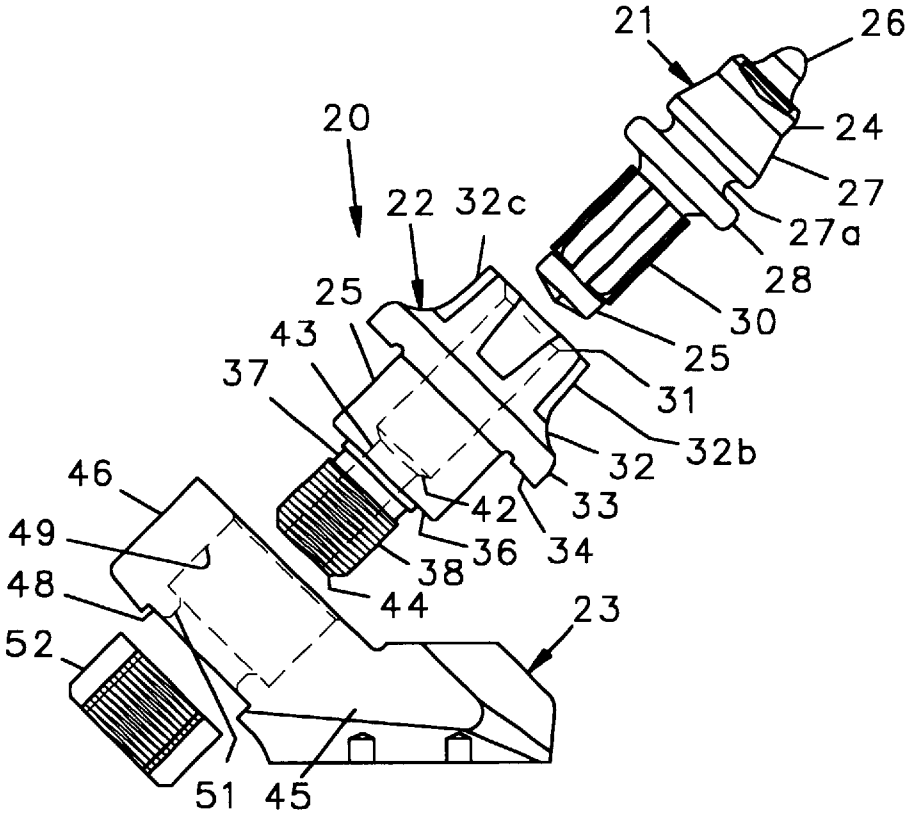
FIG. 2 is an exploded side elevational view of the assembly shown in FIG. 1.

Referring to FIG. 2, the bit, generally indicated at 21, includes a forward end 24, and a shank 25 or rear end thereof. The forward end 24 includes a hardened nose 26, preferably made of tungsten carbide or the like material, a middle tapered portion 27 including a reduced diameter area 27*a* and a bottom flange portion 28 which is made so as to rest on the bit holder, generally indicated at 22. A spring steel retaining clip 30 is positioned over the shank 25 of bit 21 and is shaped so that when the bit 21 is inserted in the bit holder 22, the retaining clip 30 will secure the bit therein while allowing it to rotate from external forces.

The bit holder 22, constructed in accordance with the present invention, includes a generally flat annular leading surface 31 on which the rear side of the bit flange 28 rests when inserted therein. Adjacent the annular leading surface 31 is a middle or tapered portion 32 that ends in an enlarged flange portion 33. In the preferred embodiment of the invention, a plurality of notches, flats or indents 32*a–d* extend radially inwardly of the middle tapered portion from top surface 31 toward the flange 33. The back side 34 of flange 33 is an annular flat surface which rests on the bit block 23 when mounted thereon, and includes one aspect of the present invention to be discussed below. Rearwardly adjacent the flange portion 33 is a reduced diameter cylindrical shank portion 35 and a tapered portion 36 which may vary in length depending on its function, an undercut portion 37 is next to the tapered portion 36, and the bit holder terminates in a threaded portion 38 adjacent the distal end 44 thereof. If the nose 26 of bit 21 hits a hard discontinuity, bit 21 will fail first, the bit holder in this embodiment may be engineered to fail next across reduced diameter section 37. The long tapered shank portion 36 allows the bit holder to tumble out of bit block bore 49 after failure.

Figure 4:
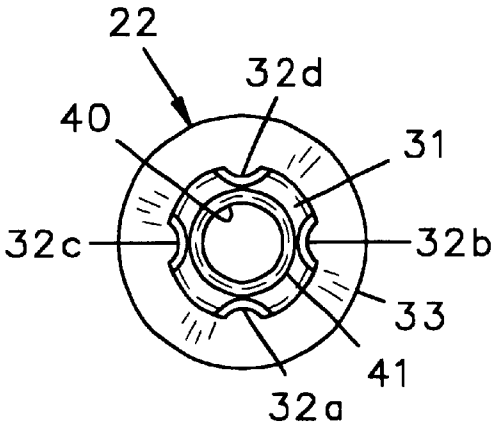
FIG. 4 is a top plan view of the bit holder shown in FIG. 3.

Also shown in FIGS. 2 and 4 is a bore 40 that extends axially through bit holder 22 from a chamfer 41 in communication with the front face 31, through the tapered portion 32, the flange portion 33 and a substantial portion of the shank 35, 36 where it narrows at chamfer 42 to a smaller diameter bore 43. Bore 43 extends the remainder of the bit holder to its distal end 44, or it may be increased in diameter partly along its length to decrease the cross sectional reduced diameter section 37, if desired. The length of the bore 40 is determined partly by the length of the shank 25 on bit 21. The shank 25 fits within bore 40, and is retained therein by the spring steel retainer 30. If the bit 21 should break at the shank 25, a rod, punch, etc. (not shown) may be inserted into the bottom of the bore to push the shank out of the holder.

Figure 1:
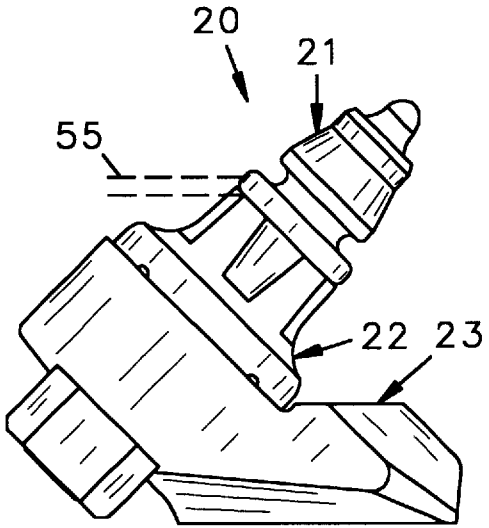
FIG. 1 is a side elevational view of a bit block, bit holder and bit assembly constructed in accordance with the present invention.
Figure 5:
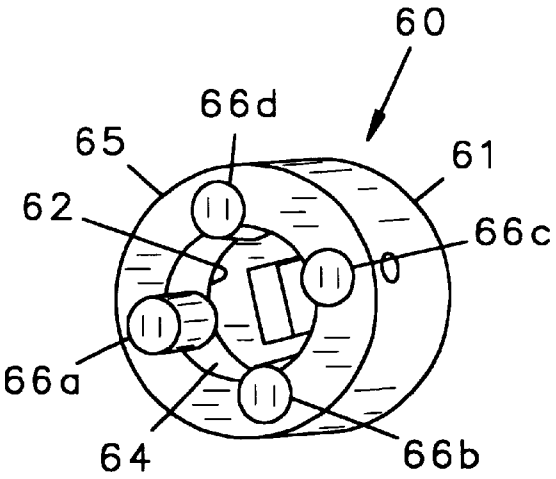
FIG. 5 is a bottom plan view of the assembly shown in FIG. 1.

Referring to FIGS. 1, 2 and 5, the bit block 23 consists of a base portion 45 that mounts to a drum (not shown) or chain (not shown) and an angled bit holder mounting portion 46 extending from the base 45 that includes a top face 47, and a bottom recessed slot 48 which provides the opposing ends for a bore 49, which may be tapered, and a reduced bridging portion 51 extending from a bottom of bore 49 to the recessed slot 48. Bore 49 is sized to receive the cylindrical shank 35 and tapered shank portion 36 of the bit holder 22 with the annular flat surface 34 on the bottom of the flange portion 33 resting on the top surface 47 of the bit block mounting portion 46. In one important aspect of the present invention, the surface area of contact between flange bottom 34 and bit block top 47 is much greater than the surface area of contact between the top 52*a* of nut 52 and nut contacting surface on slot 48 and will be discussed in greater detail below. The threaded portion 38 adjacent the distal end 44 of bit holder 22 extends through the reduced passageway 51 where a nut 52 may be threaded thereon by rotating the bit holder until its top surface 52*a* engages the surface of the recessed slot 48 to retain the bit holder 22 on the bit block 23.

Figure 3:
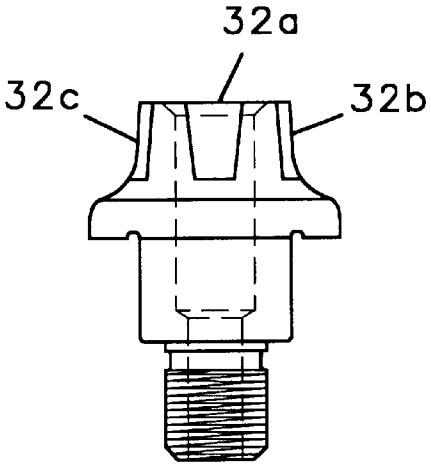
FIG. 3 is a front elevational view of a bit holder constructed in accordance with the present invention.

Referring to FIG. 1, the distal end of a pneumatically operated chisel is shown in dotted line at 55, inserted in one of the notches 32C as more fully shown in FIGS. 3 and 4. The notches 32*a–*32*d*, constructed in accordance with the present invention, allow for the quick removal of the bit 21 from the bit holder 22 by applying a force having a substantial axial component thereto to the bottom side of the bit flange 28. In the preferred embodiments there may be three or four notches or indents 32*a–d* (FIG. 4) on the bit holder 22 positioned at 120 degree or 90 degree intervals, respectively, around the circumference thereof. Each notch may be straight vertically or slightly wider at surface 31 and narrows as the notch descends toward flange 33. While the use of the punch 55 on one notch is usually sufficient to remove the bit, the punch may be utilized sequentially in differing notches to balance the axial force, if necessary, to move the bit 21 out of the bit holder 22. The notches also provide for better rotation by removing debris that may work into the bottom of flange 28. When the bit rotates, the notches will urge debris out of this area.

In its preferred operation, even though the bit can rotate axially, it is not unusual for the tip 26 and the surrounding tapered portion 27 of the bit 21 to wear unevenly on one side thereof. The bit holder 22 may also become worn unevenly during its use in the operations of milling a road or in use as a mining bit. In one aspect of the present invention, the recessed slot 48 helps to protect nut 52 from wear since the nut protrudes out of the assembly less than if there was no recess. The ability to rotate the bit holder 22 in the bit block 23 provides for extending the usable life of the assembly by being able to index the holder in 60 degree increments.

Figure 7:
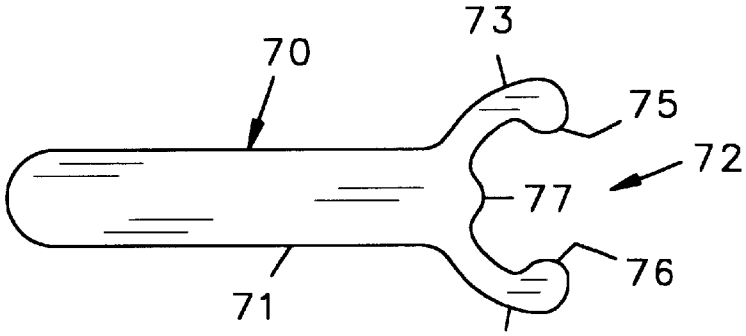
FIG. 7 is a front elevational view of the socket of FIG. 6 shown mounted on the bit holder of the invention.
Figure 8:
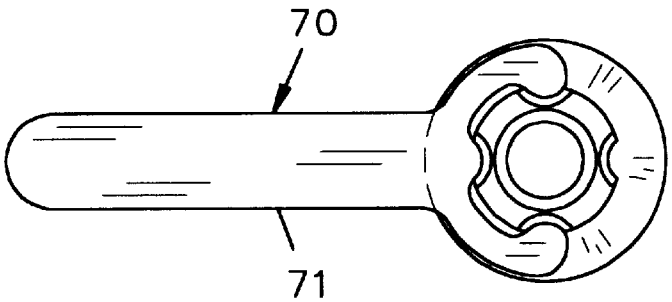
FIG. 8 is a side elevational view of a modification of the bit holder of the present invention mounted in a bit block and including a modification of a socket mounted over the bit holder to engage notches in the bit holder radial flange.
Figure 6:
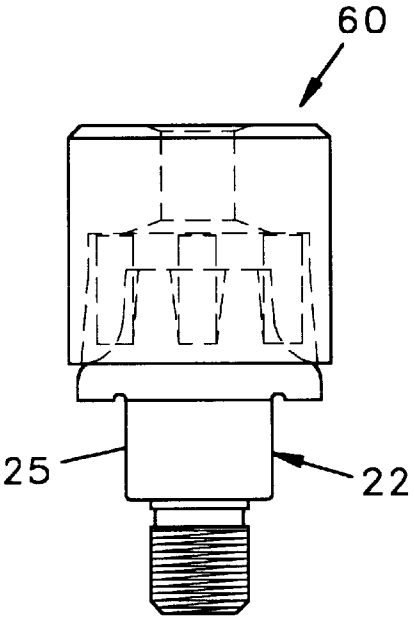
FIG. 6 is a perspective view of a bit holder tightening-loosening socket constructed in accordance with the present invention.

Referring to FIGS. 6–8, a bit holder socket, generally indicated at 60, includes a generally hollow annular cylindrical wall 61 having an enclosing end wall 62 at one end thereof with a square drive receiving passageway 63 therethrough and a generally hollow cylindrical interior surface 64 extending from the end wall 62 to an opposing annular opening surface 65. In the first preferred embodiment, four cylindrical inserts 66*a*–66*d* are positioned in respective cylindrical recesses at 90 degree intervals around the interior hollow cylindrical surface 64 so as to extend radially inwardly of that surface. As shown most clearly in FIG. 6, each of the cylindrical inserts 66*a*–66*d* is sized to fit in one of the notches 32*a*–32*d* when the socket 60 is positioned over a bit holder 22. With a ratchet, breaker bar or pneumatic impact wrench (not shown) mounted on socket 60 and the shank portion 35 of the bit holder 22 positioned in bore 49 of the bit block (FIG. 2) the combination socket 60 and bit holder 22 may be rotated to one of six desired orientations to be discussed in greater detail below, with respect to the bit block 23 and maintained in that position as the nut 52, while retained in slot 48, is threaded onto the distal end 44 of the bit holder 22 until it is securely fitted in the bit block. Nuts of varying hardness will be utilized. Also, lock nuts may be used depending on the application.

Figure 9:
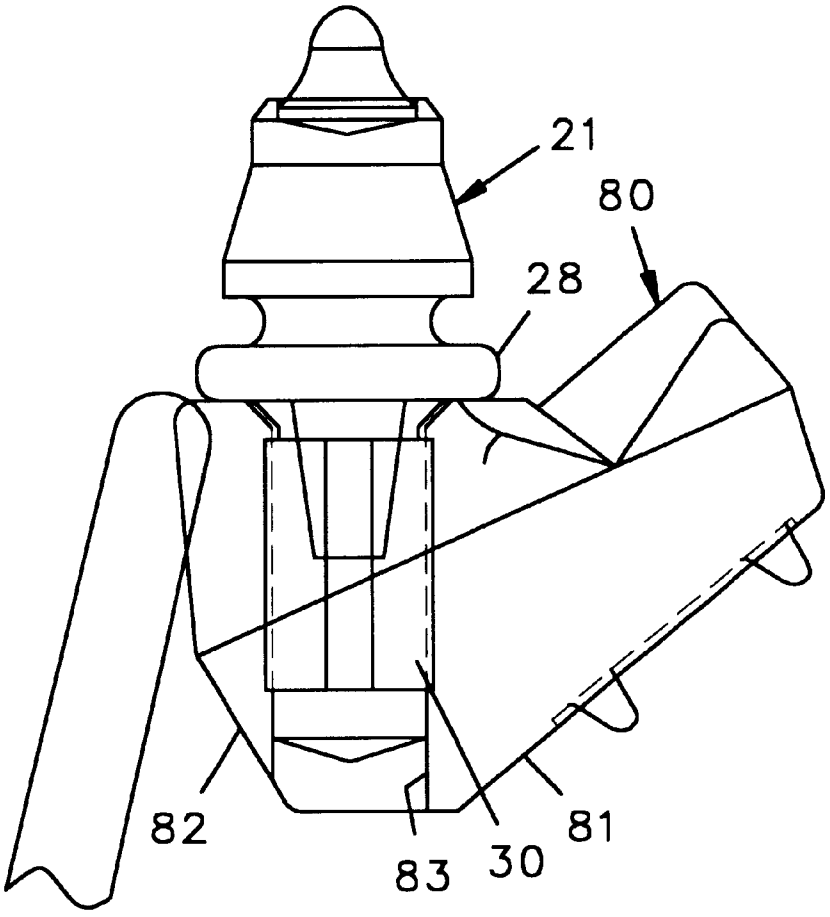
FIG. 9 is a bottom plan view of a modification of a socket having three equally spaced cylindrical detents therein.

Referring to FIGS. 8 and 9, a second embodiment of the bit holder, generally indicated at 70, is constructed similarly to bit holder 22 with the exception of a shorter tapered shank portion 71 and having a plurality of additional notches 72*a*–*c* providing equally spaced semicircular indentations around the outside of the bit holder radial flange portion 33. A second embodiment of a socket, generally indicated at 74, is larger than socket 60 and has a central recess 75*a* at the open end thereof that is large enough to fit over the outside of the bit holder radial flange 73. Socket 74 includes a plurality of cylindrical inserts 76*a*–*c* positioned in semicylindrical recesses 77*a*–*c* in evenly spaced relation around the outside of hollow recess 75*a*, complementary to notches 72*a*–*c*. With this structure, socket 74 may be inserted over bit holder 70 and the bit holder rotated by driving the socket with an impact wrench (not shown) or the like.

In operation, the mounting and removal of both bit holders 22 and 70 from their respective bit blocks 23 and 78 is an important aspect of the present invention. Rather than the bit holder being fixed (non-rotatable) on the bit block, and the fastener 52, 79, respectively, being turned on the threaded end of the bit holder, the reverse happens in applicant's invention. Taking the first embodiment as an example, nut 52 is positioned in recessed slot 48 (FIG. 5) so that it does not rotate. Since the threads inside nut 52 are fixed in position, each of the six hex surfaces of nut 52, when positioned against one of the respective flat sides of recessed slot 48 will position the threads therein in a differing radial or arcuate orientation with respect to the start and end of the threads. As a result, when the bit holder threaded portion 38 is turned on the nut 52, it will stop turning in one of six rotational positions when the bottom 34 of flange 33 contacts the top 47 of bit block 23, give or take slight movement when the rotational force, in foot-pounds, on the bit holder is increased or decreased. While the turning force may vary from 100 to about 1100 foot-pounds, within the strength of the material, a preferable range of torque to securely mount the bit holder on the bit block ranges from 400–600 foot-pounds.

As mentioned previously, since the area of contact between the bottom 34 of flange 33 against the top 47 of bit block 23 is substantially greater than the area of contact between the top 52*a* of nut 52 and the face of slot 48, there is a substantial increase, in the range of 3 to 4 times, in frictional surface grabbing between the holder and block tending to prevent rotation of the holder when the holder is rotated during mounting over prior methods used when the holder was held still and the fastener turned during mounting of the holder on the block.

Referring to FIG. 8, when the bit holder 70 is rotated to a new position on bit block 78, it is not necessary to fully remove the nut 79 from the threaded end 71*a* of the bit holder. The back of bit block 78 is notched at 78*a* to provide clearance when hex nut 79 is loosened so that surface 79*a* on nut 79 moves beyond surface 130 to allow the indexing of hex nut 79 in slot 78*c* without the nut being completely off the threads 71*a*. Thus, fast and safe adjustments of the rotational mounting position of the bit holder in the bit block according to applicant's invention provides for superior change of positioning of the bit holder in the bit block over prior such combinations.

Referring to FIGS. 2 and 3, when the leading end or hardened nose 26 of the bit 21 encounters a hard discontinuity in the surface it is removing, something has to give and quickly. In this respect, it is desirable to engineer the shapes of the bit, bit holder and bit block to assure that the part or parts destroyed in the process are chosen to be broken or destroyed rather than having the same happen by accident. If it is desirable to have the bit 21 break during such an occurrence in order to maintain the bit holder 22 and bit block 23 in working order, a reduced diameter portion 27*a* of the bit may be made a diameter such that upon the hardened end 26 striking a hard discontinuity, the bit 21 will break at the reduced diameter portion 27*a* thus saving the remainder of the assembly for future use. If it is desired that the bit block 23 remain usable and the bit holder 22 be replaceable, the reduced section 37 of the bit holder between the shank 35 and the threaded portion 38 may be made of a diameter and the shank tapered as shown in FIG. 1 so that any breakage will occur at the reduced diameter section 37. As will be shown hereafter, it may, in certain instances, be desirable to have the bit holder nose break. Additionally, an annular groove 99 (FIG. 12) between the notches and the radial flange may be sized to provide for failure between groove 99 and the central bore when the hardened end 26 of the bit 21 encounters a hard discontinuity, thus allowing the bit to tumble out of the top of the bit holder 22, while the remaining radial flange protects the top surface of the bit block.

Figure 10:
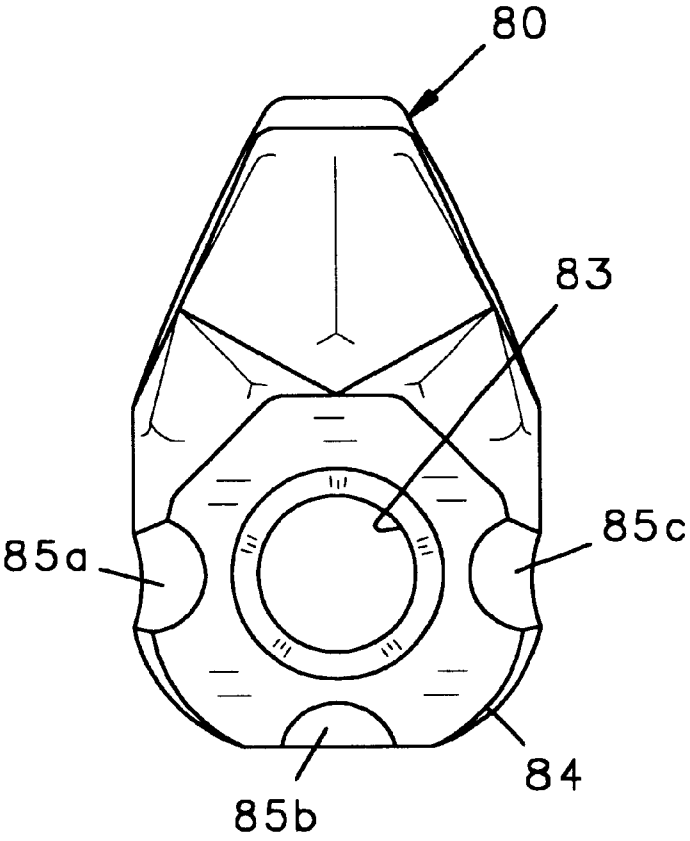
FIG. 10 is a side elevational view of a second embodiment combination bit holder/bit block constructed in accordance with the present invention having a bit mounted therein and showing a pneumatically operated impact tool positioned to remove the bit utilizing the notches of the present invention.
Figure 11:
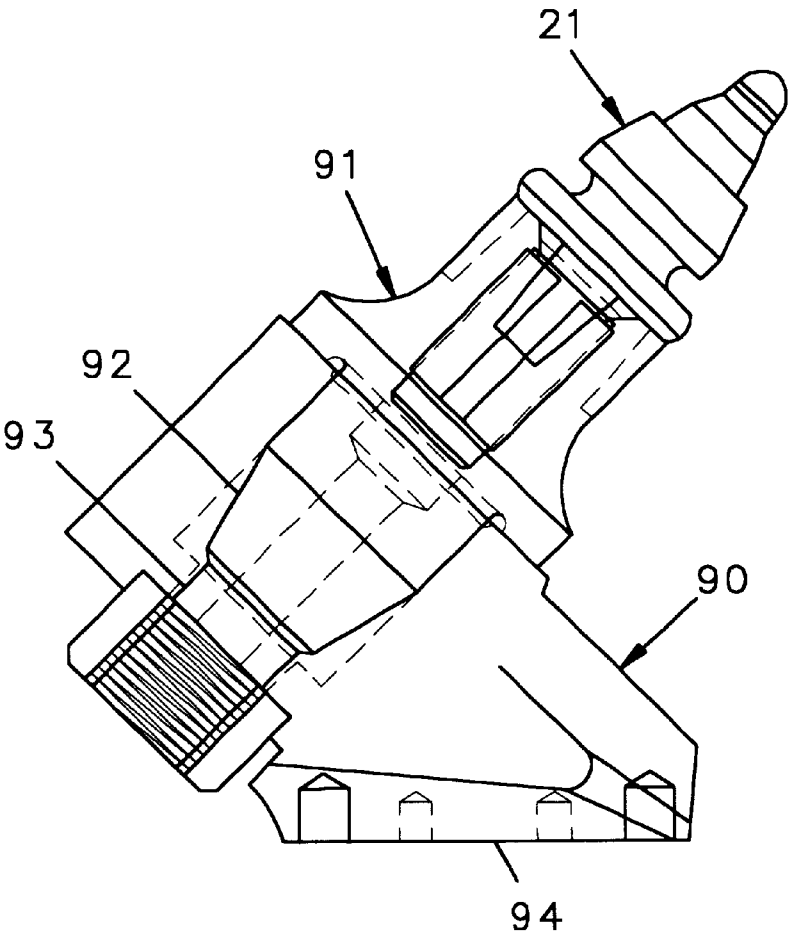
FIG. 11 is a top plan view of the combination bit block/bit holder shown in FIG. 10 showing the notches therein constructed in accordance with the present invention.

Referring to FIGS. 10 and 11, a differing shape combination bit holder/bit block, generally indicated at 80, includes a mounting surface 81 and a bit holding body 82 extending therefrom including a bore 83 into which a bit, generally indicated at 21, is retained by the spring steel retainer 30 previously discussed. The bit flange 28 rests on a top flat surface 84 of the combination block/holder 80. In this embodiment, three notches 85*a*–*c* are positioned at 90 degree intervals around the body 82 and extend upwardly to be in communication with top surface 84 of the combination block/holder. When the bit 21 is retained in the combination block holder 80, as shown in FIG. 10, a pneumatic punch 86 may be used similarly to the pneumatic punch 55 shown in FIG. 1 by being inserted into one of the slots 85*a*–*c* until it contacts the underside of the bit flange 28 to provide a substantial axial component of force to move the bit 21 upwardly out of the bore 83 of the combination block/holder 80.

Figure 12:
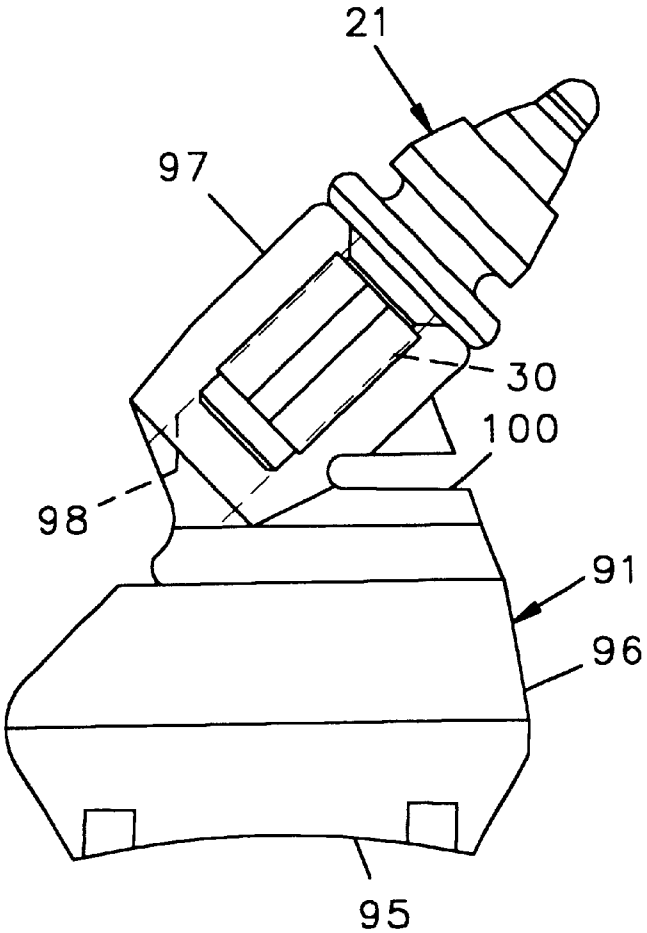
FIG. 12 is a view similar to FIG. 1 of a third embodiment of a bit holder further including a half tapered shank on the bit holder.
Figure 13:
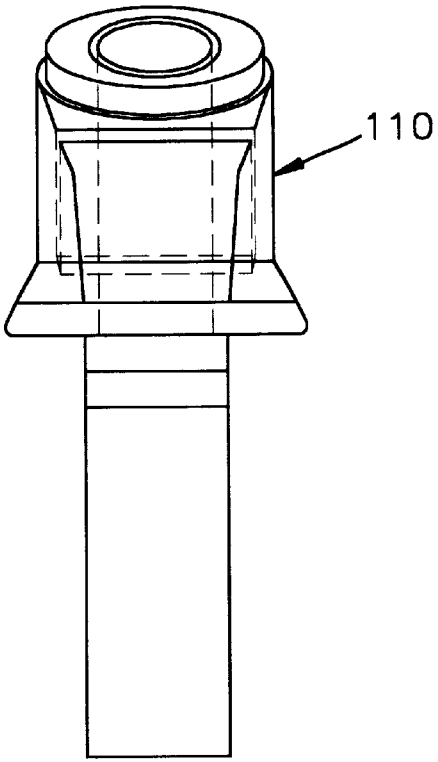
FIG. 13 is a side elevational view of a fourth combination bit block/bit holder having a slot formed therein for breakage purposes.

Referring to FIGS. 12 and 13, bit blocks, generally indicated at 89 and 91, while having a differing appearance, both provide for mounting the bits 21 the same distance from the mounting drum and at the same angle. Bit block 89 retains therein a bit holder generally indicated at 90. The smaller tapered shank (in comparison to longer tapered shank 36 of the first embodiment) avoids having a concentrated corner stress point that would be present if the cylindrical shank 92*a* extended to the bottom of the bit block bore.

It should be noted that while the mounting surface 94 of bit block 89 is not quite the same as the curved mounting surface 95 of bit block 91, both surfaces are mountable on the flight (outer wall) of a drum which makes the bit blocks interchangeable in use. It should be noted that the mounting holes 94*a–b* are positioned in the same alignment as threaded holes 95*a–b* on bit block 91 for complete interchangeability.

The bit block/holder 91 includes a mounting body 96 extending upwardly from the circular mounting surface 95 and ends at a bit mounting portion 97 having a bore 98 therethrough into which the bit 21 is retained by the spring retainer 30. In order to provide for the intended failure of the holder 92 if the bit 21 encounters a hard discontinuity, an indentation type slot 100 is formed between the body 96 and the bit mounting portion 97. In the event the bit 21 encounters a hard discontinuity, the bit holder 92 is engineered to fail across the bit mounting portion from the inner end of slot 100 to the bore 98, thereby saving the mounting body 96. In FIG. 12, bit holder 90 is engineered to fail first in order to save the bit block 89.

Figure 14:
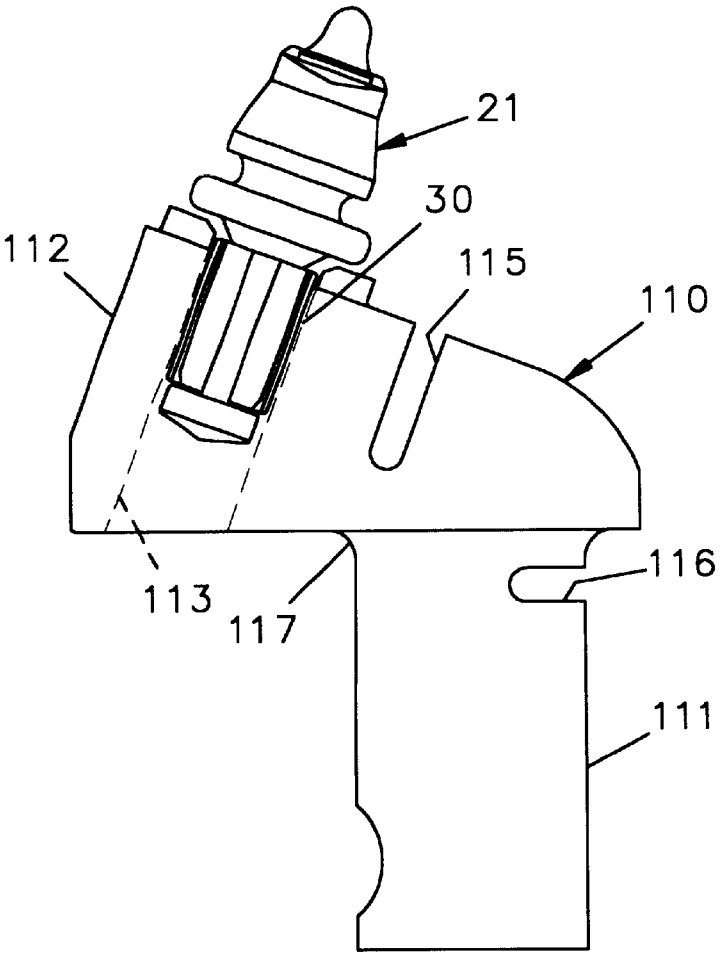
FIG. 14 is a side elevational view of a bit holder having a bit mounted therein and showing the breakage slots of the invention formed thereon.

Referring to FIG. 14, a sixth embodiment of a bit mounting body is shown, generally indicated at 110, and includes a shank portion 111 and a bit receiving portion 112 having a bore 113 therethrough into which a bit 21 is retained by a spring steel retainer 30. The bit block is not shown. As shown most clearly in FIG. 14, slots 115 and 116 are positioned in the bit receiving portion 112 and the shank portion 111, respectively, to provide for failure of the bit mounting body at one of those positions when the bit 21 encounters a hard discontinuity. One or both slots may be used. The failure of the bit receiving portion from the base of slot 115 through to the opposing side of the bit receiving portion designated 117 or from the base of the slot 116 through to the opposite side of the bit receiving portion 117 will save the bit block (not shown) in the event of such an occurrence.

Figure 15:
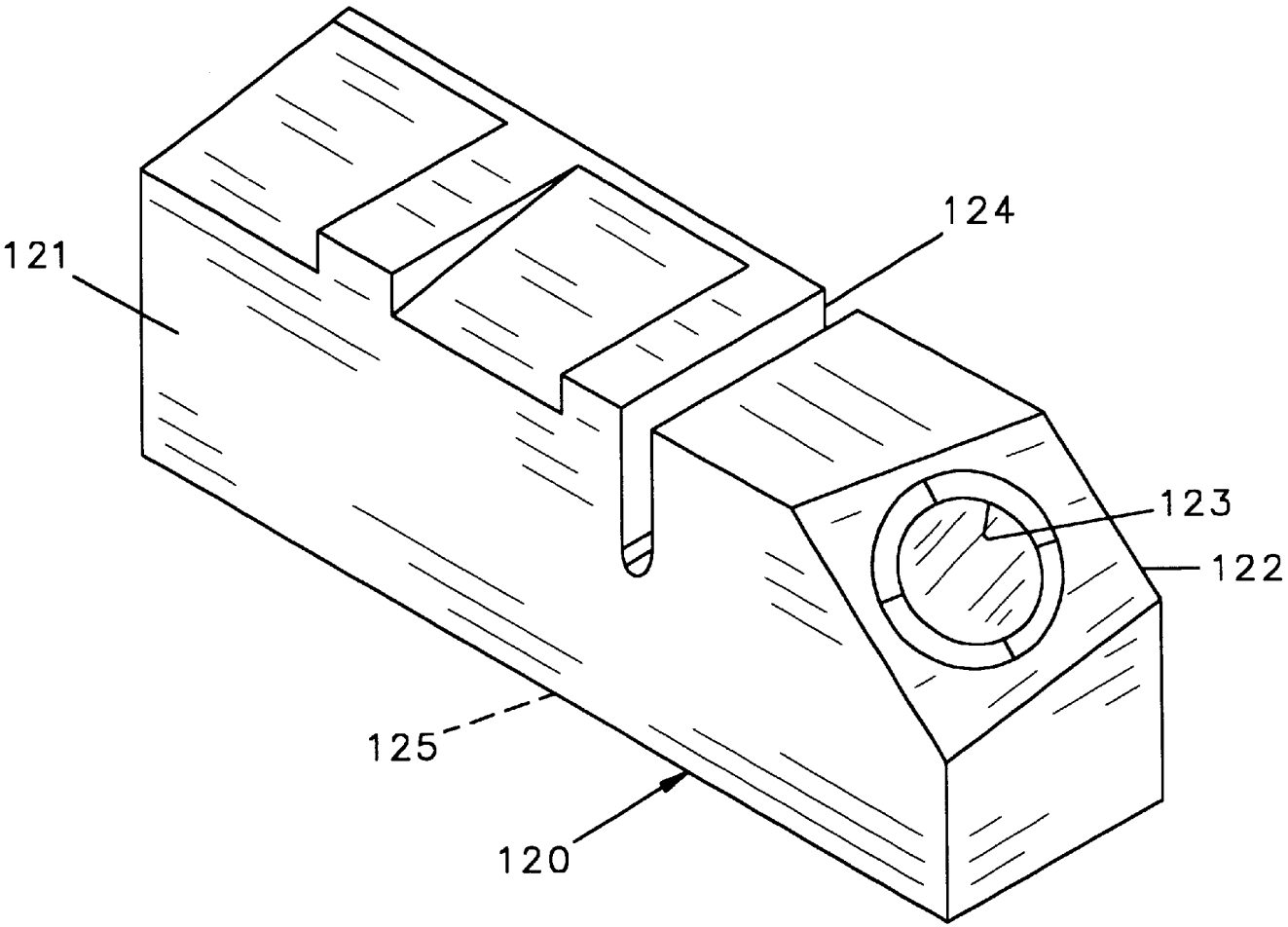
FIG. 15 is a perspective view of a sixth embodiment combination bit block and bit holder shown having a breakage slot of the invention formed thereon.

FIG. 15 shows a seventh embodiment of a bit holder, generally indicated at 120, that includes a rectangular mounting portion 121 and a terminal distal bit mounting surface 122 having a bore 123 extending inwardly therefrom through the bit holder 120 for mounting a bit 21 therein (not shown). As shown most clearly in FIG. 15, a slot 124 extends part way through the bit holder 120 between the mounting portion 121 and the bit mounting surface 122 to provide for failure of the bit holder from the bottom end of slot 124 through to the opposing side 125 of the bit holder, if the bit 21 (not shown) should encounter a hard discontinuity. Failure of the bit holder 120 at the slot 124 will save the expensive bit holder mounting configuration and allow the replacement of inexpensive bit holder.

Improvements in bit holders and bit holder/blocks have been shown that provide for rotating the bit and bit holder in a bit block and mounting the holder in the block in a superior and more secure manner, ease of removability of bits from bit holders and for providing for the engineered failure of parts of less expensive parts of the bit, bit holder, bit block combination if the bit should encounter a hard discontinuity while working.

While seven embodiments of the present invention have been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. A bit assembly for use in road milling and mining equipment including a bit having a hardened distal end connected to a shank portion and means including a shank receiving bore for mounting said bit on said equipment, said means for mounting said bit on said equipment include, a combination bit holder/bit block including a base having a bottom mounting surface and a bit mounting portion extending therefrom including said shank receiving bore therethrough, an improvement comprising:

reduced cross section means on one of said bit and said means for mounting said bit on said equipment for providing a predetermined area of failure for when said bit contacts a hard discontinuity in material it encounters, said reduced cross section means include a slot positioned partially through at least one of said base and said bit mounting portion.

2. A bit assembly for use in road milling and mining equipment including a bit having a hardened distal end connected to a shank portion and means including a shank receiving bore for mounting said bit on said equipment, said means for mounting said bit on said equipment include, a generally annular bit holder including a bit mounting portion, a holder shank portion, and a threaded distal end, said annular bit holder having a bore axially therethrough for insertion of said bit therein, a reduced diameter portion of said annular bit holder positioned between said holder shank portion and said threaded distal end, an improvement comprising, reduced cross section means on one of said bit and said means for mounting said bit on said equipment for providing a predetermined area of failure for when said bit contacts a hard discontinuity in material it encounters, said reduced cross section means include, an increased diameter portion of said bore extending axially through said bit holder.

* * * * *